US005117595A

United States Patent [19]

Brendel

[11] Patent Number: 5,117,595

[45] Date of Patent: Jun. 2, 1992

[54] DEVICE FOR ERECTING AND ALIGNING A TILTING TELESCOPIC MAST MOUNTED ON A TRANSPORT VEHICLE

[75] Inventor: Richard Brendel, Pottenstein, Fed. Rep. of Germany

[73] Assignee: GEROH GmbH Mechanische Systeme, Waischenfeld, Fed. Rep. of Germany

[21] Appl. No.: 598,606

[22] PCT Filed: Feb. 20, 1990

[86] PCT No.: PCT/EP90/00272

§ 371 Date: Oct. 19, 1990

§ 102(e) Date: Oct. 19, 1990

[87] PCT Pub. No.: WO90/09341

PCT Pub. Date: Aug. 23, 1990

[30] Foreign Application Priority Data

Feb. 20, 1989 [DE] Fed. Rep. of Germany ..... 3905180

[51] Int. Cl.[5] ..... B66C 23/36

[52] U.S. Cl. ..... 52/115; 212/189; 52/118; 280/840

[58] Field of Search ..... 52/118, 115; 212/189; 280/840

[56] References Cited

U.S. PATENT DOCUMENTS 2,375,264 5/1945 Wagner et al. ..... 212/189
4,397,396 8/1983 Kay et al. ..... 212/189

FOREIGN PATENT DOCUMENTS 2652244 6/1977 Fed. Rep. of Germany .
1210581 12/1958 France .

*Primary Examiner*—David A. Scherbel
*Assistant Examiner*—Wynn Wood
*Attorney, Agent, or Firm*—Wenderoth, Lind & Ponack

[57] ABSTRACT

A device raises and aligns a tiltable telescopic mast which is mounted on a transport vehicle and which can be raised by one or more lifting cylinders from a horizontal or almost horizontal transport position in a vertical plane parallel to the longitudinal axis of the transport vehicle up to a vertical position of the mast in this plane. Vertically adjustable support booms brace the telescopic mast on the ground in a vertical plane transverse to the longitudinal axis of the transport vehicle. The device includes a supporting frame for the telescopic mast and which is connected to the vehicle frame so as to be vertically adjustable three lifting elements, and four support booms that are mounted on the supporting frame and each of which can be lowered and swung out by actuating only one pull device.

9 Claims, 5 Drawing Sheets

DEVICE FOR ERECTING AND ALIGNING A TILTING TELESCOPIC MAST MOUNTED ON A TRANSPORT VEHICLE

BACKGROUND OF THE INVENTION

The present invention relates to a device for raising and aligning a tiltable telescopic mast that is mounted on a transport vehicle and that can be raised by means of one or more lifting cylinders from a horizontal or almost horizontal transport position in a vertical plane parallel to a longitudinal axis of the transport vehicle up to a vertical position of the mast in this plane, and which includes devices in the form of vertically adjustable support booms, to brace the telescopic mast on the ground in a vertical plane transverse to the longitudinal axis of the transport vehicle.

A device for raising and aligning a tiltable telescopic mast mounted on a transport vehicle is known from DE 31 05 621 C2. Furthermore, a lifting device disclosed in DE-OS 26 52 244 also comprises a tiltable telescopic mast mounted on a transport vehicle, where the transport vehicle can be braced on the ground by means of support booms.

SUMMARY OF THE INVENTION

The object of the present invention is to provide a device of the aforementioned type but which makes it possible in a simple manner to raise and align a tiltable telescopic mast mounted on a transport vehicle in the vertical direction with little loss of time, where owing to the only short movements of the individual parts negligible bending moments are exerted on such mechanical parts and the process of raising and aligning can be readily automated.

This object is achieved by the provision of a device which comprises:

a) a supporting frame for the telescopic mast and which is connected to a frame of the vehicle so as to be vertically adjustable by means of three lifting elements, b) four support booms that are mounted on the supporting frame and each of which can be lowered and swung out and by actuating only one pull device.

According to a preferred feature, each support boom is connected to the supporting frame by means of an upper, Cardan joint and a bottom guide pin sliding in a connecting link guide of the supporting frame.

According to another preferred feature, the pull device, which acts both to swing out and to lower each support boom, is a spindle drive. Thus, it is possible to lower the support boom reliably, without play and with accuracy.

According to yet another preferred feature, the bottom end of the support boom that faces the supporting frame and with which the pull device engages can be drawn into a bottom guide located in the supporting frame. Thus, it is achieved that following the lowering of the support booms, which brace the extended telescopic mast, a system that is mechanically intrinsically very stable is formed.

According to still another preferred feature, the three lifting elements, which are attached between the supporting frame for the telescopic mast and the vehicle frame and which bring about vertical adjustment between the supporting frame and the vehicle frame, are dimensioned in such a manner that after the telescopic mast has been raised and placed in position, the transport vehicle can be lifted from the ground by suitably actuating the lifting elements. In this case the telescopic mast has contact with the ground only by means of the four support booms, preferably with the insertion of base plates, and the transport vehicle that is raised from the ground and at this stage hangs via its vehicle frame and the threaded spindles from the supporting frame of the telescopic mast represents a ballast, a feature that contributes to further stabilization of the erected telescopic mast.

According to an even further preferred feature, the lifting elements and/or the lifting cylinder are/is formed by threaded spindles or by hydraulic drives or hydraulic motors.

Telescopic masts, in particular telescopic latticed 5 masts, can have a significant height of, e.g., up to 45 m. Such movable telescopic masts can be used, e.g., as antenna masts for directional antennas, in particular parabolic antennas. In the present device the supporting frame represents a central unit of the antenna carrier to which are coupled all elements to be moved. Thus, all forces acting on the telescopic mast are absorbed and dissipated over the hinged-on support booms. The supporting frame has in known manner two torsion-rigid bearing blocks defining a swivel bearing around which the telescopic mast attached thereto can be raised from a horizontal or near horizontal transport position into a vertical position. This is achieved in the conventional manner by means of the lifting cylinder(s). The supporting frame is connected to the vehicle frame by means of the lifting elements. Since usually the transport vehicle never stands absolutely horizontally in the longitudinal and transverse directions at the site where the mast will be raised, however a prerequisite being that the extended telescopic mast, in particular with tall telescopic masts, be aligned as perpendicularly as possible at the set-up site, the telescopic mast must be aligned in the vertical direction both in the vertical plane parallel to the longitudinal axis of the transport vehicle and in the vertical plane transverse to the longitudinal axis of the transport vehicle. At the site of erection the supporting frame is first aligned as horizontally as possible, especially in the plane transverse to the longitudinal axis of the transport vehicle, by actuating the three lifting elements that are mounted between the supporting frame and the vehicle frame. Then an alignment in the direction of the longitudinal axis of the transport vehicle can occur simultaneously, provided that this is allowed by the clearance of motion of the lifting elements.

In the preferred embodiment wherein the transport vehicle is subsequently raised from the ground, the lifting elements are then further extended by a suitable length, e.g. 20 cm, i.e., the distance between supporting frame and vehicle frame is enlarged by 20 cm while maintaining the previously set alignment.

Finally, the four support booms are swung out and lowered preferably individually in succession. The support booms are mounted in such a manner on the supporting frame that, when the respective pull devices are actuated, they are first swing out of their transport position adjacent to the vehicle and then are lowered. This lowering is performed only until each support boom has contact with the ground. This contact occurs advantageously via a base plate for better distribution of weight, and the external end of each support boom is designed as a ball engaging with a ball socket of the base plate. Finally, by actuating the lifting cylinder(s) the telescopic mast that is still in the transport position is raised vertically around the swivel bearing until the mast is placed exactly vertically in position.

Since the telescopic mast is aligned in this manner, both in the vertical plane parallel to the longitudinal axis of the transport vehicle and vertically transverse to the longitudinal axis of the transport vehicle, and this alignment is not modified by individually lowering differently the four support booms in the ground, the vertical alignment of the telescopic mast remains preserved. Then the telescopic mast is preferably extended, i.e. extended to its full length. It is possible in this manner to align the telescopic mast, e.g. by 10°, in each direction with respect to non-horizontal terrain.

As described above, it is possible to lift the vehicle by lifting the transport vehicle from the ground by simultaneously actuating the lifting elements and reducing the distance between supporting frame and vehicle frame so that the vehicle hangs freely from the supporting frame and acts as ballast, resulting in still better stability of the extended telescopic mast.

BRIEF DESCRIPTION OF THE DRAWINGS

The invention will be explained in detail below with reference to the accompanying drawings, wherein.

DETAILED DESCRIPTION OF THE INVENTION

Figure 1:
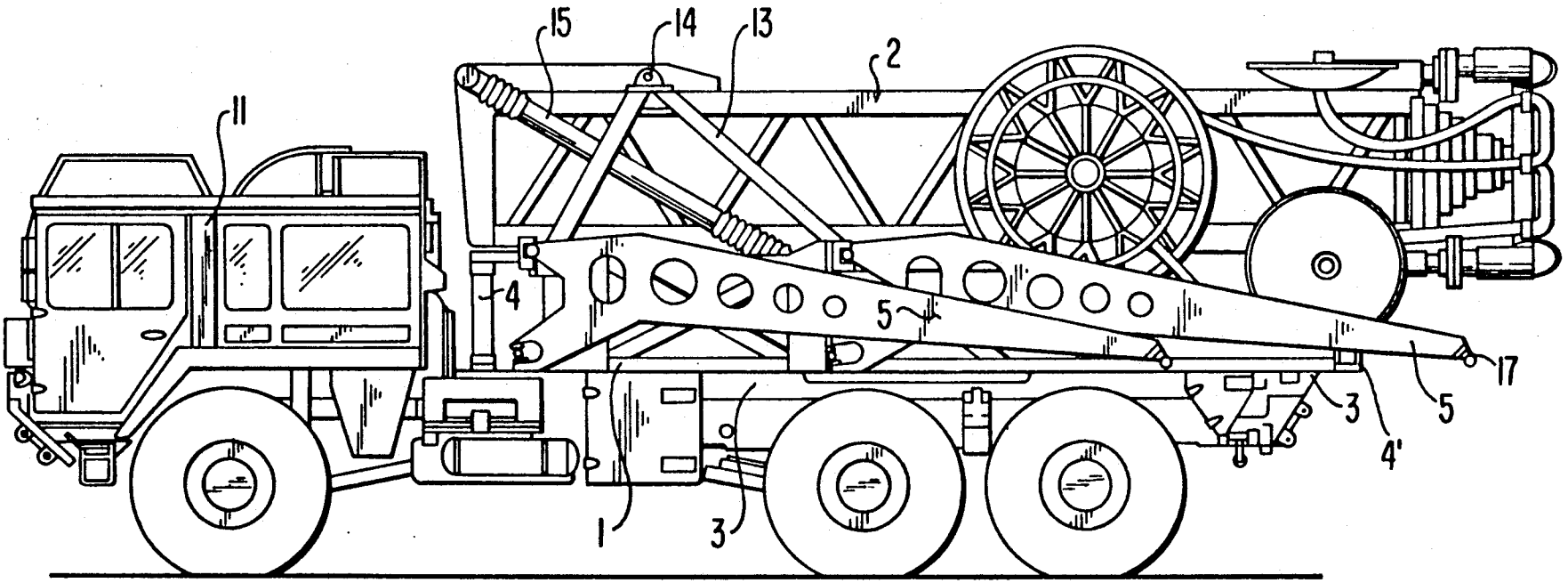
FIG. 1 is a side view of a transport vehicle with a telescopic mast in a transport position.
Figure 2:
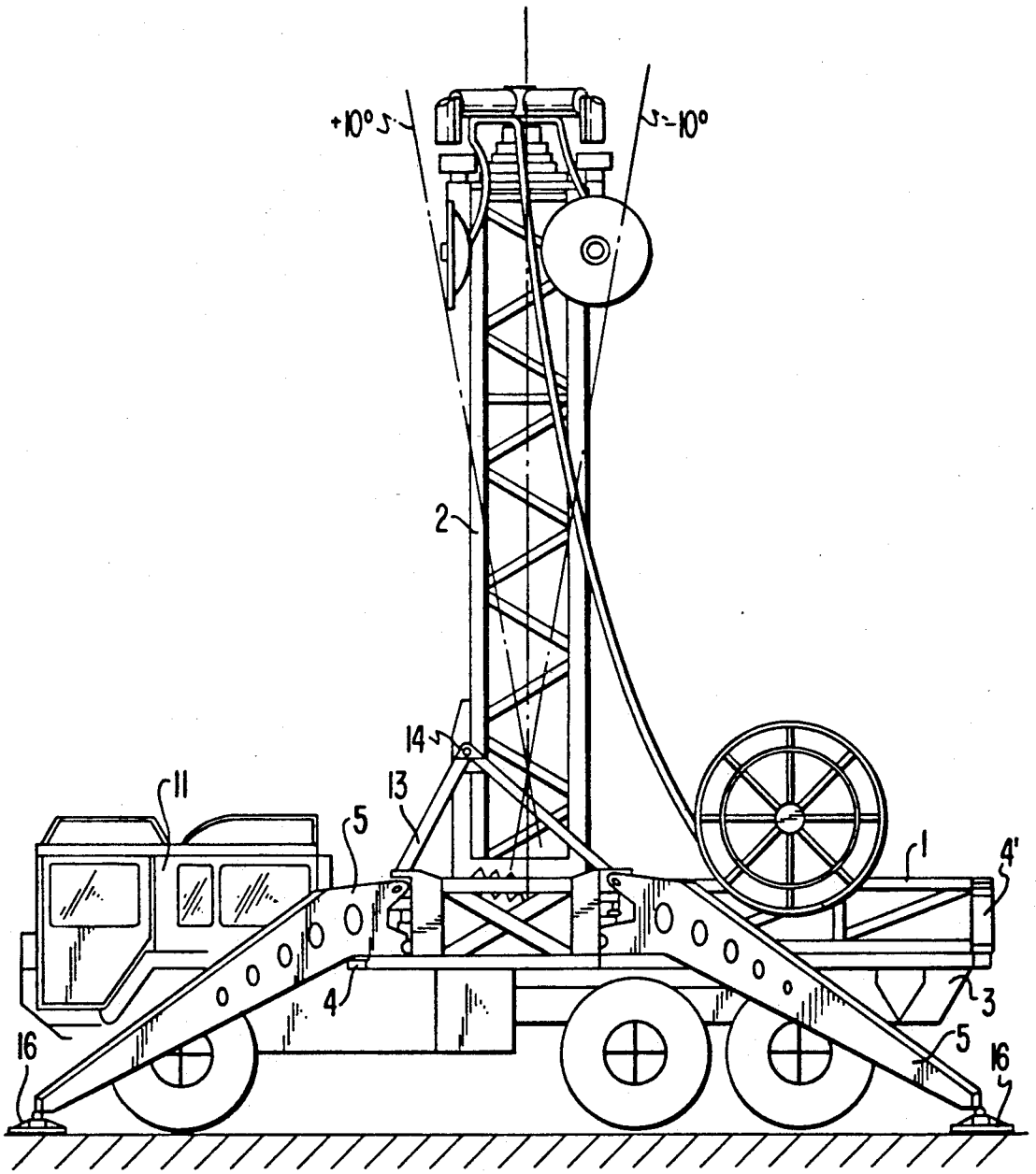
FIG. 2 is a side view of the transport vehicle with the telescopic mast erected and with support booms swung-out and lowered.

In FIG. 1 a transport vehicle is denoted as 11. The transport vehicle includes a vehicle frame 3. At the rear end of the vehicle a threaded spindle 4' and behind an operator's cabin of the vehicle two threaded spindles 4 are integrated into a supporting frame 1, which is formed by a lattice work or structure, as is more apparent from FIG. 5. The threaded spindles are braced at bottoms thereof on vehicle frame 3. Furthermore, two support booms 5, which in the transport position are next to the transport vehicle 11, are mounted on each side of the vehicle. The support booms are hinged at the top and bottom thereof to supporting frame 1. Attached to the supporting frame are two bearing blocks 13 which define a swivel bearing 14 around which telescopic mast 2 can be raised by actuating a lifting cylinder 15 to a vertical raised position as shown in FIG. 2. In FIG. 2, supporting frame 1 is already lifted a short distance from vehicle frame 3 by actuating threaded spindles 4 and 4' and is aligned in such a manner that the erected, still telescoped telescopic mast is aligned as vertically as possible. Furthermore, in FIG. 2 support booms 5 are already swung out and lowered, thus making contact with the ground via base plates 16. Spherical ends 17 of the support booms, shown in FIG. 3, engage with such base plates 16. Then the telescopic mast can be extended, and if desired the transport vehicle can be lifted from the ground by actuating threaded spindles 4 and 4'.

Figure 3:
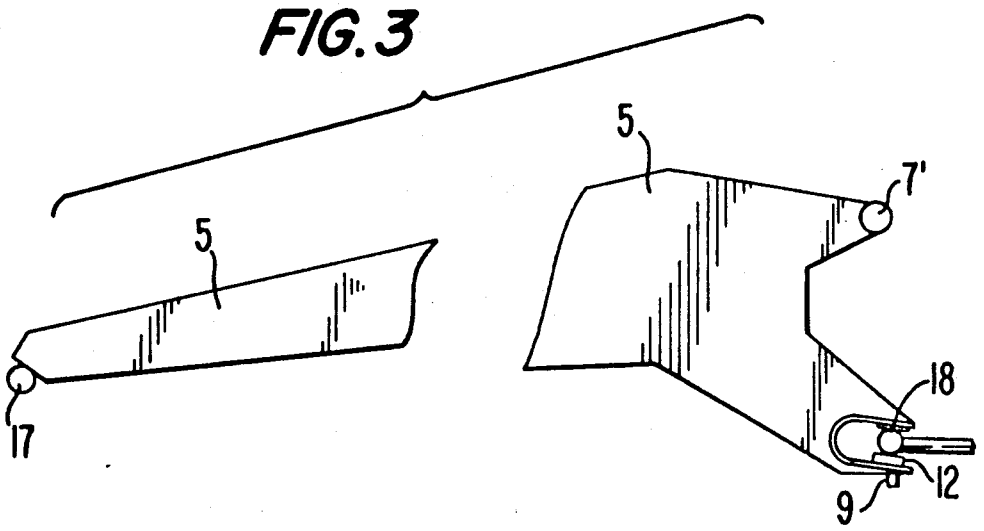
FIG. 3 is a detailed view of bearing ends of a support boom.
Figure 4:
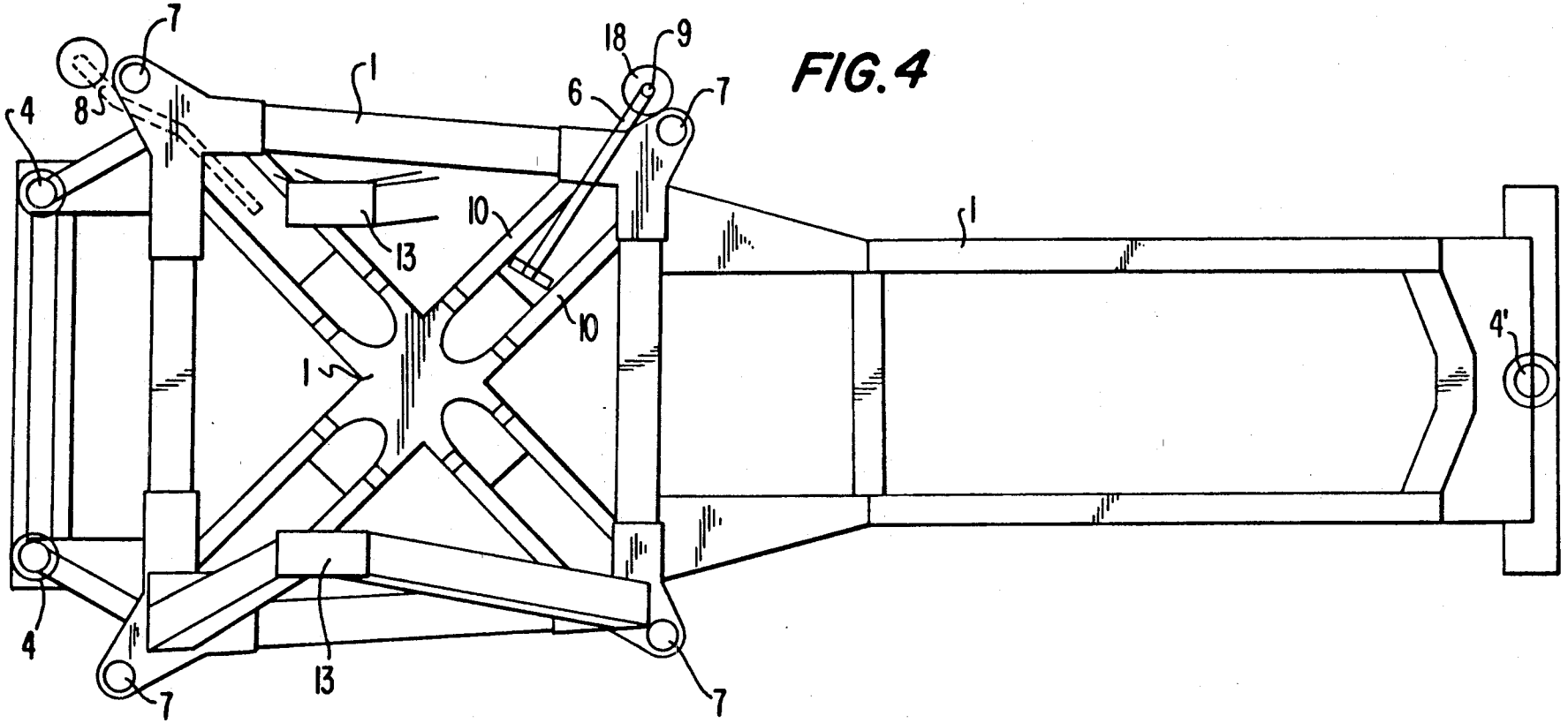
FIG. 4 is a top view of a supporting frame and illustrating mounting points for the support boom and guides for a bottom end of the support boom.
Figure 5:
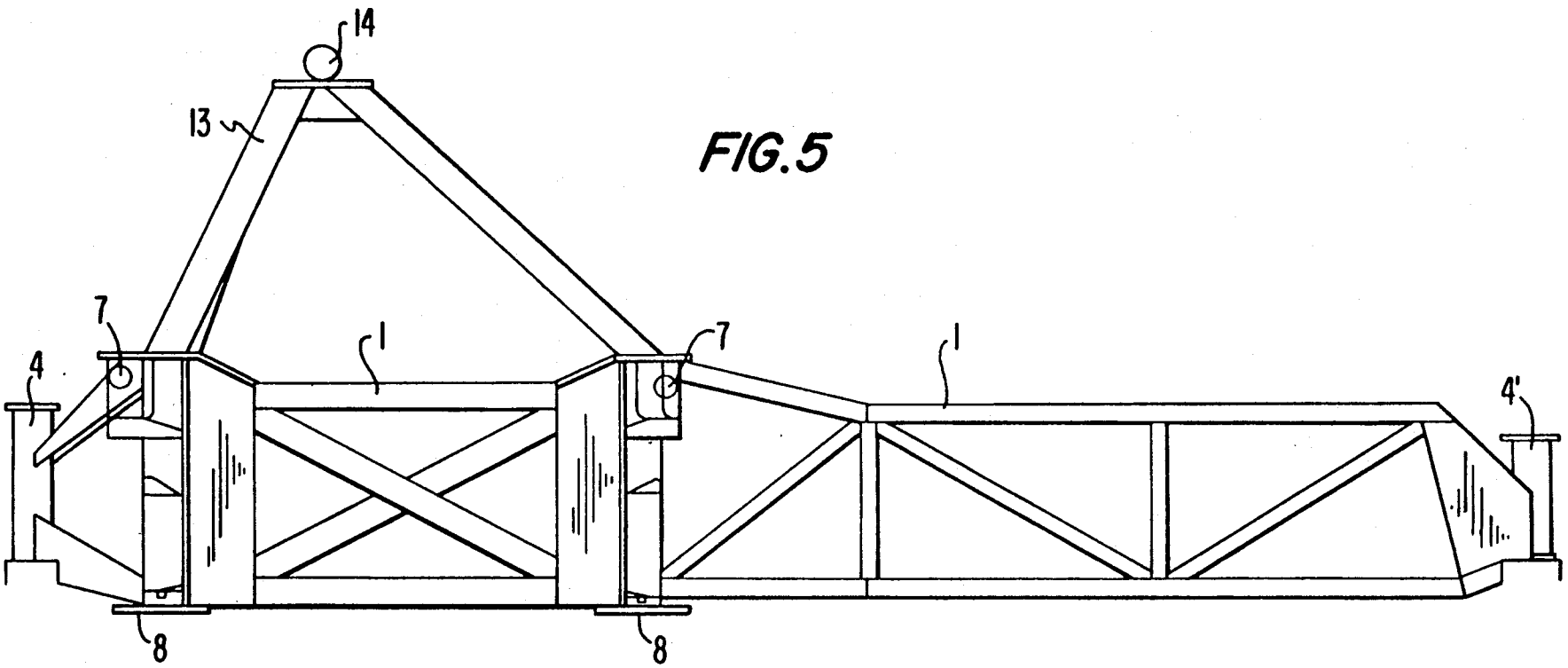
FIG. 5 is a side view of the supporting frame.

FIG. 3 shows the end of a support boom that can be hinged to the supporting frame 1. An upper mounting point 7' is a Cardan joint, so that the support boom can be lowered after it has been swung out from the transport position shown in FIG. 1. A bottom mounting point 12 of support boom 5 engages a pull device, preferably a spindle drive, which causes the support boom not only to be swung out but also to be lowered. Such a pull device is denoted schematically at 6 in FIG. 4. A bottom guide pin 9 engages with a connecting link guide 8 shown at the top right in FIG. 4. The upper point of rotation 7 and the guide pin 9 are not vertically below one another so that when pull device 6 is actuated and thus guide pin 9 is moved in the connecting link guide 8, support boom 5 not only is swung out but also is lowered. FIG. 4 also shows cross-shaped, lateral guides 10 for the bottom end of support booms 5. Upon actuation of pull device 6, such bottom end of support boom 5 slides into a respective guide 10, which preferably is in the form of a U-shaped rail, such that the support boom is held reliably. FIG. 5 is a side view of supporting frame 1 and shows the arrangement of threaded spindles 4 and 4' and the pivotal points 7 and 8 of support booms 5, and also a bearing block 13 with swivel bearing 14. The pull device 6 also advantageously is a threaded spindle, where a pull rod engages by means of a ball 18 with the bottom mounting point 12 of the support boom, as shown in FIG. 3.

I claim:

1. In an assembly of a vehicle frame of a transport vehicle, a telescopic mast raising means for raising said mast relative to said vehicle frame from a substantially horizontal transport position in a vertical plane parallel to a longitudinal axis of the vehicle to a vertical position in said plane, and support means for bracing said mast relative to a ground surface in a plane transverse to said axis, the improvement comprising:

a supporting frame supporting said mast and connected to said vehicle frame for vertical adjustable movement relative thereto by three lifting elements, such that said supporting frame is tiltable relative to said vehicle frame to align said supporting frame and thereby said mast in a desired alignment relative to the horizontal; and said support means including four support booms, each said support boom being mounted on said supporting frame to be swung out away therefrom and to be lowered relative thereto into contact with the ground surface by a respective single pull device;

whereby said supporting frame and said mast may be aligned relative to said vehicle frame by operation of said three lifting elements and without operation of said support booms, and whereby thereafter said support booms may be operated to brace said mast relative to the ground surface without lifting of said supporting frame relative thereto.

2. The improvement claimed in claim 1, wherein each said support boom is connected to said supporting frame by a respective upper bearing and a respective bottom pin slidable in a respective connecting link guide of said supporting frame.

3. The improvement claimed in claim 1, wherein each said single pull device comprises a spindle drive.

4. The improvement claimed in claim 1, wherein each said support boom has a lower inner end movable into a bottom guide of said supporting frame.

5. The improvement claimed in claim 1, wherein said lifting elements are dimensioned such that, after said supporting frame and said mast are aligned relative to the horizontal by operation of said lifting elements in a first direction, and after said support booms are operated to be braced against the ground surface, said lifting elements are operable in a reverse second direction sufficient to lift the vehicle off the ground surface.

6. The improvement claimed in claim 1, wherein said lifting elements comprise threaded spindles.

7. The improvement claimed in claim 1, wherein said raising means comprise threaded spindles.

8. The improvement claimed in claim 1, wherein said lifting elements comprise hydraulic drive members.

9. The improvement claimed in claim 1, wherein said raising means comprise hydraulic drive members.

* * * * *